United States Patent [19]

Burgess et al.

[11] Patent Number: 4,814,219

[45] Date of Patent: Mar. 21, 1989

[54] FUSION OF THERMOPLASTIC FABRICS

[75] Inventors: Kenneth W. Burgess, Seneca; Wayne K. Erickson, Spartanburg; William R. Bryant, Seneca, all of S.C.

[73] Assignee: Phillips Petroleum Company, Bartlesville, Okla.

[21] Appl. No.: 130,148

[22] Filed: Dec. 8, 1987

Related U.S. Application Data

[60] Division of Ser. No. 780,878, Sep. 27, 1985, abandoned, which is a continuation of Ser. No. 542,962, Oct. 18, 1983, Pat. No. 4,576,852.

[51] Int. Cl.[4] ..... B32B 5/12

[52] U.S. Cl. ..... 428/113; 428/171; 428/284; 428/296; 428/300

[58] Field of Search ..... 428/113, 171, 296, 300, 428/904, 284

[56] References Cited

U.S. PATENT DOCUMENTS

| | | | |
|---|---|---|---|
| 3,096,557 | 7/1963 | Messinger | 26/1 |
| 3,096,563 | 7/1963 | Messinger | 28/78 |
| 3,206,351 | 9/1965 | Smith | 428/113 |
| 3,231,650 | 1/1966 | Findlay et al. | 264/128 |
| 3,454,413 | 11/1967 | Miller | 117/5.5 |
| 3,499,810 | 3/1970 | Wagle et al. | 156/152 |
| 3,733,234 | 5/1973 | Dunning | 156/209 |
| 3,994,759 | 11/1976 | Stoller | 156/85 |
| 4,075,383 | 2/1978 | Anderson et al. | 428/198 |
| 4,134,948 | 1/1979 | Baker, Jr. | 264/518 |
| 4,135,024 | 1/1979 | Callahan | 428/171 |
| 4,151,023 | 4/1979 | Platt | 156/62.2 |
| 4,306,929 | 12/1981 | Menikheim et al. | 156/290 |
| 4,342,813 | 8/1982 | Erickson | 428/296 |
| 4,396,452 | 8/1983 | Menikheim et al. | 156/290 |

FOREIGN PATENT DOCUMENTS 2085938 5/1982 United Kingdom .

*Primary Examiner*—James J. Bell

*Attorney, Agent, or Firm*—George E. Bogatie

[57] ABSTRACT

Process and apparatus are provided for production of novel fused fabrics by treating a feed fabric comprising a substantial portion of thermoplastic fibers with wetting agent then subjecting the wetting fabric to conditions of temperature and pressure suitable to cause fusing together of at least some fibers of the fabric.

7 Claims, 2 Drawing Sheets

FUSION OF THERMOPLASTIC FABRICS

This application is a divisional of application Ser. No. 780,878, filed 9-27-85 now abandoned, which is a continuation of application Ser. No. 542,962, filed 10-18-83 now U.S. Pat. No. 4,576,852.

BACKGROUND OF THE INVENTION

1. Field of the Invention

This invention relates to a process for preparing fused fabrics. The invention also relates to apparatus for the production of fused fabrics. In another aspect, the invention relates to novel fused fabrics per se.

2. Description of the Prior Art

Thermoplastic fabrics are widely employed in furniture construction, civil engineering applications and the like. A common method employed to stabilize thermoplastic fabrics is to subject the fabric to conditions of heat and pressure sufficient to cause fusion of at least some of the fibers of the fabric. A problem with this procedure is that fabric strength of previously heat stabilized fabric as measured by ultimate strength and tear strength tests is usually reduced by subjecting the fabric to additional heat and pressure.

For some applications of thermoplastic fabrics, an embossed pattern impressed upon the fabric is desired. The embossing treatment compresses and densifies the fabric in the areas that are embossed. This treatment enhances the structural integrity and mechanical strength of the treated fabric.

In U.S. Pat. No. 4,135,024 there is disclosed an embossing process wherein a treating fluid is applied to the rear surface of a web simultaneously with the contacting of the web with an embossing roll. The web employed preferably includes over 50% by weight wood pulp fibers. Apparently fusion of the fibers in the web is not desired or accomplished since there is no disclosure of the application of heat in the embossing process.

U.S. Pat. No. 4,075,383 relates to a method for pattern bonding non-woven fabric made from polyamide filaments by treating the fabric with an acid activating agent and water vapor prior to passing the fabric between a pair of rolls, at least one of which is embossed and heated sufficiently to cause bonding of discrete portions of the fabric. The activating agents such as HCl, $BF_3$, $SO_2$ and the like are corrosive and undesirable chemicals to handle, yet are required to effect the desired bonding.

U.S. Pat. No. 3,454,413 describes a process for embossing a sheet material by printing a pattern on selected portions of the sheet material with a heat retarding liquid, then subjecting the printed sheet material to a heat source to cause areas unprotected by retarding liquid to become recessed in relation to protected areas. Thus, a mask or some means for selective application of heat retarding liquid is required such that fusion of the sheet material occurs only where heat retarding liquid has not been applied.

U.S. Pat. No. 4,134,948 deals with embossing a non-woven fabric comprising approximately 75% wood pulp fibers and 25% synthetic cellulose fibers by applying moisture to the batt, then passing the moistened batt through heated embossing rolls. Sufficient moisture is applied to insure good pattern definition. An embossing temperature of only 155°-170° F. is disclosed with further heating to drive off water and cure adhesive additive provided after adhesive application to the embossed batt.

U.S. Pat. No. 3,096,557 teaches passing of fabric wet with hot water (180°-200° F.) under pressure and at a temperature 10°-200° F. below the softening point of the synthetic polymer of the fabric between two confining rollers, one being a hard, rough-surfaced roller. Due to the temperatures employed, fabric fusion apparently does not occur.

U.S. Pat. No. 3,096,563 is similar to '557 discussed above. The temperature of the heated, rough-surfaced roll is specified to be 10°-100° F. below the softening point of the synthetic polymer of the fabric.

U.S. Pat. No. 4,306,929 describes a process for the preparation of point-bonded non-woven fabrics wherein thermally bondable fiber web containing an attenuating liquid is simultaneously heated and compressed in spaced, discrete areas. Only up to about 80% of the total surface area of the web is treated to heat and compression conditions. The function of the attenuating liquid is to prevent web fibers in the uncompressed areas of the web from reaching bonding temperatures. A point-bonded fabric of improved softness with no increase in fabric strength is said to be the result of such treatment.

U.S. Pat. No. 4,396,452 is similar to '929 discussed above. Autogenously bondable fiber web is specified and a point-bonded product of improved softness and increased fabric strength is said to result.

It is therefore an object of this invention to provide a process for the preparation of fused fabric. It is a further object of this invention to provide apparatus for the preparation of fused fabric. It is yet another object of this invention to provide fused fabrics per se. It is a further object of this invention to provide fused fabrics with increased strength, reduced thickness and a soft hand. It is yet another object of this invention to provide fused, embossed fabrics having improved pattern definition. It is yet another object of this invention to provide a non-woven fabric having a leather-like appearance.

These and other objects of our invention will become apparent from the disclosure and appended claims.

SUMMARY OF THE INVENTION

In accordance with one aspect of the present invention, feed fabric is treated with a wetting agent, then the wetted fabric is subjected to a temperature and a nip pressure along the entire length of the nip sufficient to cause fusion of at least a portion of the fibers of the fabric.

In accordance with another aspect of the invention, feed fabric is treated with a wetting agent, then the treated fabric is passed to the nip of nip rolls wherein at least one of the nip rolls is heated, said nip having a first temperature and a nip pressure sufficient to raise the temperature of the wetting agent to a second temperature which is sufficient to raise the temperature of at least a portion of the fibers of the fabric to their softening or stick point.

In accordance with another aspect of the present invention, apparatus are provided comprising means for treating substantially all of a feed fabric with wetting agent and nip rolls for heating and applying pressure along the entire length of the nip sufficient to cause fusion of at least a portion of the fibers.

In accordance with yet another aspect of the present invention, fused thermoplastic fabrics are provided.

The fused fabrics of the invention achieve the benefit of improved fabric dimensional stability usually obtained upon fusion treatment of fabrics, in addition to retaining the integrity of the individual fabric fibers. Thus, a fabric with improved dimensional stability which retains its soft hand and porosity is obtained. Smooth calender roll fused fabrics of the invention have a felt-like feel (rather than a glazed surface) and reduced fabric thickness per weight of fabric. Embossed, non-woven fabrics of the invention, depending on the embossing pattern employed, have the look of woven fabric or the appearance of leather, both with excellent pattern definition and retention.

DETAILED DESCRIPTION OF THE INVENTION

Fabrics

Figure 1:
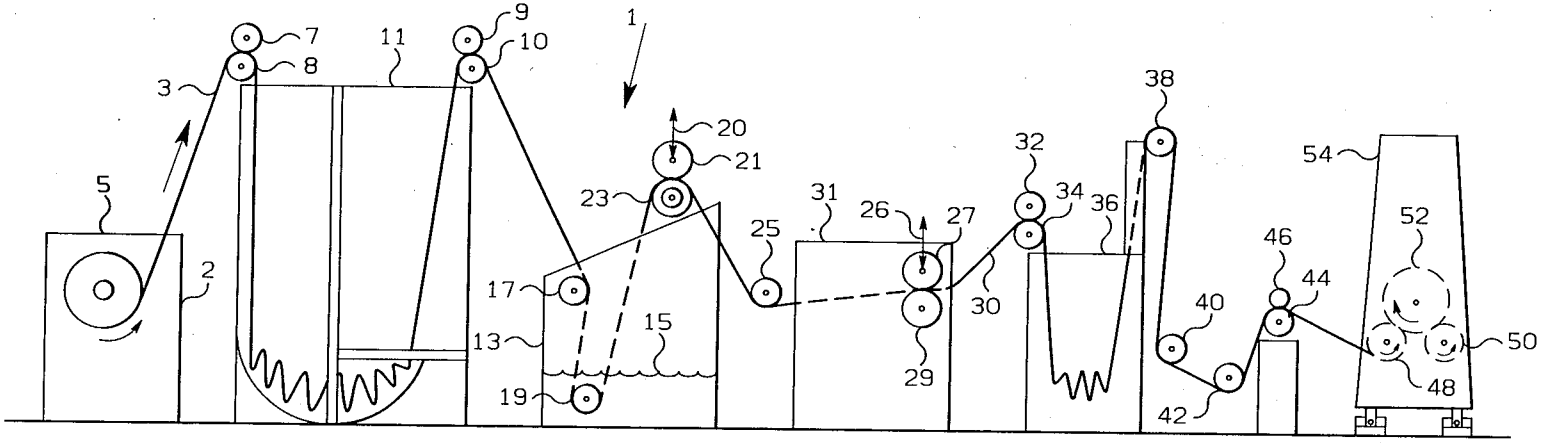
FIG. 1 is a schematic illustration of one embodiment of an apparatus of the invention.

The process of the present invention may be applied to any woven, knitted or non-woven fabric constructed from a substantial portion of thermoplastic fibers. In one aspect, the invention is particularly applicable to non-woven fabrics. In another aspect, the invention is particularly applicable to crosslapped non-woven fabrics. Thus, crosslapped non-woven fabrics can be fused employing the apparatus and process of the invention to produce fused non-woven fabrics that, depending on treatment conditions employed, look and feel like woven fabrics or have a leather appearance, and have improved fabric strength in both the fill (or transverse) and the warp (or machine) directions. The term "fibers" as used herein refers to either staple fibers or continuous fibers employed in making the fabrics. Typical examples of such fibers include those prepared from such thermoplastic materials as polyamides such as polycaprolactam and copolyamides, polyesters such as polyethylene terephthalate and copolyesters, polyacrylonitrile and copolymers of acrylonitrile, vinyl and vinylidene polymers and copolymers, polycarbonates, polyurethanes, polyester-amides, polyolefins such as polyethylene and polypropylene, fluorinated polyolefins, poly(arylene sulfide) compounds such as poly(phenylene sulfide) and the like and mixtures of any two or more thereof.

Natural staple such as wool, cotton and the like may be incorporated into the fabric treated according to the present invention in any desired amount. As indicated above, the fabric employed according to the present invention will contain a substantial portion of thermoplastic fibers. Typically, at least 50 percent by weight of thermoplastic fibers will be employed. Preferably, at least 75 percent by weight of the fabric will be thermoplastic fibers, with a fabric having about 15 percent by weight or less of natural staple being most preferred.

Where synthetic staple fibers are employed to prepare the fused fabrics of the present invention, the staple length can be selected from a broad range. Usually the staple has a length within a range of about 1 to about 10 inches. More typically, staple length in the range of about 2 to about 7 inches is employed. Preferably, staple with a length of about 2 to about 5 inches is employed because such staple processes easily and produces a fabric with excellent properties.

Staple denier can be selected from a wide range of deniers. Normally the denier is in a range of about 1 to 20. More commonly, deniers within a range of about 1½ to about 16 denier are employed with about 2 to about 10 denier preferred since higher denier fabrics are not as readily wetted as those in the preferred range. Also, for fabrics having a soft hand, the smaller deniers are preferred, such as for example, from about 1 to about 5 denier.

Although not necessary to the practice of this invention, non-woven fabrics prepared from staple fibers are preferably needle punched, for example, as described in U.S. Pat. No. 4,154,889. The preparation of a preferred unfused, crosslapped, non-woven fabric which can be employed in the practice of the present invention is described in U.S. Pat. No. 4,342,813, which disclosure is incorporated by reference herein.

Fabrics treated according to the present invention can have a weight selected over a relatively broad range. Generally, fabrics having a weight of about 1 to about 20 ounces per square yard are employed. Preferably fabrics having a weight of 1 to about 15 and most preferably 2 to about 14 ounces per square yard will be employed.

The widths of the fabrics produced according to the invention can vary widely. Widths achievable are limited only by the size equipment one has available for fabric treatment.

The feed fabric subjected to the inventive fusion process can be unfused, previously fused on one side only or on both sides. Such prior fusion of the feed fabric can be accomplished by any means, such as infrared fusion or hot roll fusion.

Wetting Agent

The wetting agent employed in the practice of this invention can be any liquid which will be absorbed into at least some of the void spaces of the thermoplastic fabric without significant dissolution thereof, and which vaporizes at or below the softening point of the thermoplastic fabric. In addition, the wetting agent may also contain additional modifying agents such as dyes, pigments, binders, bleaching agents, thickening agents, softening agents, detergents, surface active agents and the like and mixtures of any two or more thereof.

Suitable wetting agents include water, and water containing minor amounts of alcohols, such as methanol, ethanol and propanol, aromatics such as toluene and xylene, chlorinated hydrocarbons such as carbon tetrachloride and the like. Water is preferred since it is inexpensive, readily available and creates minimum "handling" problems upon vaporization.

The wetting agent can be applied to the fabric in any suitable manner. For example, the feed fabric can be sprayed on one or both sides with wetting agent prior to contact with the heated fusion rolls. Alternatively the feed fabric can be used through the wetting agent contained in a vessel and then brought into contact with the heated fusion roll. As another variation, feed fabric wetted by passing through the wetting agent contained in a vessel can be further contacted to remove some of the wetting agent prior to contact with the heated fusion roll. Thus, for example, squeeze rolls or heated rolls may be employed, positioned ahead of the heated fusion roll and associated back-up roll to control the amount of wetting agent retained by the fabric prior to contact with the heated fusion roll.

Any amount of wetting agent added to the feed fabric will result in a fused fabric with increased strength and/or improved pattern definition and/or improved soft hand. Typically about 1 to 200 weight percent of wetting agent, based on the dry weight of the feed fabric, will be employed. Preferably the wetted fabric prior to contact with a heated fusion roll will contain about 20 to 100 weight percent wetting agent, based on the weight of dry feed fabric. Most preferably, the wetted fabric will contain about 30 to about 90 weight percent wetting agent based on the weight of the dry feed fabric.

For best results, i.e., optimum increase in fabric strength and pattern definition upon fusion treatment, it is desirable that the fabric be essentially uniformly treated with the wetting agent. The resulting fused fabric has improved strength and reduced thickness for a given weight of fabric compared to fused fabrics of the prior art.

Modifying Agents

If desired, the fabric can be subjected to a variety of modifying agents at any suitable point during the fabric processing. Thus, components such as dyes, pigments, binders, bleaching agents, thickening agents, softening agents, detergents, surface active agents and the like and mixtures of any two or more thereof may suitably be applied to the fabric before or after application of wetting agent, as well as during the application of wetting agent, as discussed above. In some cases, modifying agents can suitably be applied after the fabric is subjected to fusion conditions.

Treatment Conditions

The temperature of the heated fusion roll must be high enough to raise the temperature of the wetting agent to a temperature which is sufficient to cause fusion of at least a portion of the fibers in the treated fabric. That temperature is dependent on a number of parameters, such as, for example, the composition of the fabric, the fabric speed, the fabric weight, the nip pressure applied to the fabric by the fusion roll, the type and amount of wetting agent employed, and the like. As a minimum, the temperature employed should be at least about the softening point or stick point of the lowest melting component of the fabric being treated under the particular conditions employed. For example, where polypropylene fabric is treated, a suitable temperature range is about 163°-191° C. (325°-375° F.). Higher temperatures within the suitable temperature range can be employed where high fabric feed rates are utilized, thereby reducing the time the fabric is in contact with the heated fusion roll. Lower temperatures within the suitable temperature range can be employed, for example, where the fabric has been treated with low melting binders. Thus, temperatures up to the point where essentially complete melting of all the fibers of the fabric occurs are suitable.

The heated fusion rolls can be heated, for example, by interior circulating hot oil, resistance heaters, high pressure steam or other suitable heating fluid passed through the core thereof.

As noted above, the temperature of the heated fusion roll can be varied somewhat depending on the pressure applied at the nip to the fabric and the rate at which fabric is brought into contact with the heated fusion roll. Typically, lower temperatures are required where higher nip pressures are employed. Although the application of most any pressure to the fabric will aid the fusion process, nip pressures of about 20 to about 10,000 pounds per lineal inch (pli) are typical. Preferred pressures are about 50 to 5000 pli, with pressures of about 100 to about 3000 pli most preferred. Pounds per lineal inch as reported herein are determined by multiplying the total area of the piston(s) of the cylinder(s) bearing down on the fusion roll times the gauge pressure provided to the piston(s) of the cylinder(s) in psig times the mechanical advantage, if any, divided by the width of the roll of feed fabric.

For purposes of this invention, it is intended that the conditions of temperature and nip pressure ad detailed above be applied across substantially the entire width of the fabric.

The rate at which fabric is brought into contact with the heated fusion roll is limited only by the equipment employed. Where high fabric feed rates, i.e., greater than about 50 feet per minute, are possible, higher temperatures and/or nip pressures will be appropriate. Where equipment limitations require slow fabric feed rates, reduced fusion temperatures and/or nip pressures are advisable to prevent fabric degradation.

The wetted fabric can be subjected to fusion conditions in a variety of ways. Thus, the wetted thermoplastic fabric may be passed between a smooth heated roll and smooth rubber backup roll. Alternatively, the backup roll could be a smooth metal roll. As yet another alternative, the wetted fabric may be passed in contact with a heated embossing roll backed by a smooth rubber roll or a smooth metal roll. As noted above, the feed fabric treated according to the present invention can be previously fused prior to treating with wetting agent and contacting with a heated fusion roll. Thus, where feed fabric has been previously fused on one side, such as, for example, as described in U.S. Pat. No. 4,105,484 and U.S. Pat. No. 4,151,023, it can be brought into contact with a heated fusion roll in such an orientation that the face side (fused side) or back side (unfused side) of the feed fabric is brought into contact with the fusion roll after the feed fabric is treated with wetting agent. As also noted above, feed fabric at least partially fused on both sides can be further fused by the process of the present invention. Thus, such feed fabric can be subjected to fusion by a smooth heated roll or a heated embossing roll, in either case employing such as a smooth rubber, smooth metal or cloth wrapped backup roll. Other means of feed fabric fusion employing such as a heated embossing roll and a smooth heated roll or two smooth heated rolls or two heated embossing rolls are included in the scope of this invention.

Apparatus

The drawing figures provided which constitute a part of this disclosure merely illustrate specific embodiments of this invention. They are not intended to limit the scope of this invention or the appended claims in any way.

Figure 2:
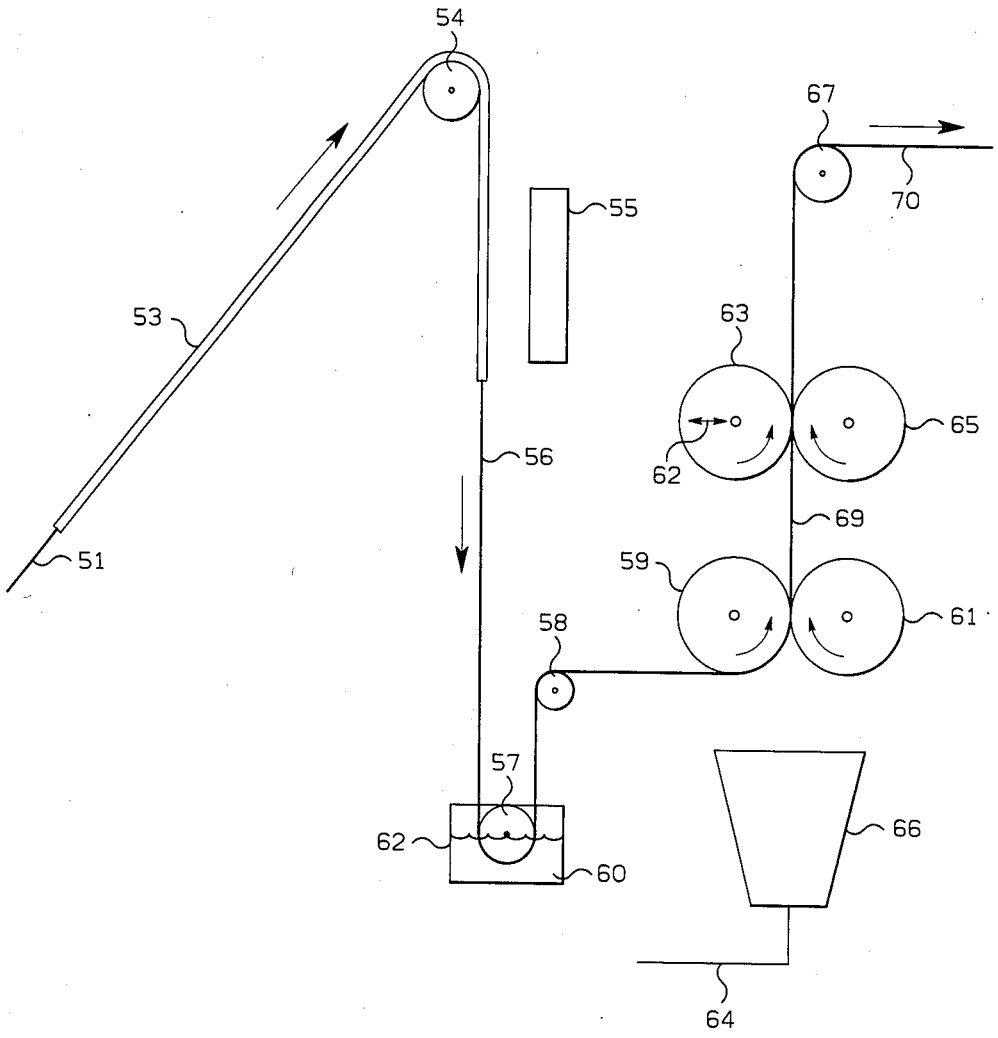
FIG. 2 is a schematic illustration of another embodiment of an apparatus of the invention.

Now referring to the drawings, FIG. 1 schematically illustrates one embodiment of the apparatus of the invention useful for producing the fused fabric of the invention. Feed fabric 3 is drawn from a supply source, roll 5, supported on roll stand 2 through the first idler roll 7 and driven roll 8 into suitable surge means such as as J-box 11 which collects a surge of material. Although the use of a J-box is optional, it is a preferred means for controlling the feed rate of feed fabric to the fabric treating apparatus. Other feed means such as, for example, a tenter frame as shown in FIG. 2 can also be employed for feed fabric. From J-box 11 the feed fabric is drawn through the second idler roll 9 and driven roll 10, across idler roll 17 into wetting agent containing tank 13, around idler roll 19 through a wetting agent 15 such as water, and then through a pair of squeeze rolls 21 and 23. Squeeze roll 21 has hard surface such as steel or rubber. The nip pressure of rolls 21 and 23 is adjusted by means not shown in an up or down direction shown by arrow 20 to press the fabric against roll 23 to remove the excess wetting agent from the fabric. Roll 23 is a driven roll while roll 21 is an idler roll. Roll 23 is optionally fabric wrapped to aid removal of wetting agent from feed fabric 3. The fabric wrap optionally employed on roll 23 can be one or more layers of absorbent non-woven fabric, such as, for example, cotton-filled or polypropylene fabric. Alternative means for applying wetting agent to the feed fabric include, but are not limited to a spray nozzle, a wetted kiss roll, a dip tank, and the like.

The wetted fabric 3 is then drawn around idler roll 25 into the embossing frame 31 through embossing roll 27 and backup roll 29 to emboss a pattern on the face of the fabric and to substantially remove the remainder of the wetting agent from the fabric. Alternatively, roll 27 could be a smooth heated roll, thereby providing a smooth fused fabric. Further, backup roll 29 can be a heated smooth or embossed roll. Thus, a fabric embossed on one or both sides could be produced, as well as a smooth fabric fused on one or both sides, or a fabric embossed on one side and subjected to smooth fusion on the other. Roll 27 and backup roll 29 are both driven. The nip pressure between roll 27 and backup roll 29 is adjustable by means not shown in the direction of the arrow 26. Roll 27 can be heated for example, by steam, resistance heaters, or hot oil to the desired temperature such as about 375° F. for polypropylene fabric to enhance the embossing step. The embossed fabric 30 is drawn from the embossing rolls by idler roll 32 and driven roll 34 into J-box 36 to provide a surge of fabric 30 which passes over idler rolls 38, 40 and 42, tension rolls 44 and 46 and by takeup rolls 48 and 50 which are driven to form a roll of fused fabric 52 on rollup frame 54.

FIG. 2 is a schematic illustration of another embodiment of the invention wherein a manufacturing line forming a non-woven feed fabric 51, such as described in U.S. Pat. No. 4,342,813, is attached to a tenter frame 53 which stretches the feed fabric transversely to a desired amount and holds the fabric along its edges as the fabric is drawn around idler roll 54 and the face side is optionally dry fused by such as infrared heat from heat source 55. The term dry fusion refers to fusion treatment of feed fabric which has not been treated with wetting agent. The fabric 56 is then drawn through wetting agent such as water 60 in wetting agent tank 62, around roll 57, idler roll 58, and then through heat stabilizing rolls 59 and 61 to remove excess wetting agent. Roll 59 can optionally be fabric covered as discussed above or a hard rubber backup roll or any other type of roll suitable for providing the nip pressure required to aid removal of the excess wetting agent in the fabric which is allowed to drain into drain pan 66 and out through drain 64. Wetting agent collected through drain 64 can be returned to tank 62 for further application to fabric 51. The fabric 69 with wetting agent reduced to the desired amount is then drawn through heated roll 63 and backup roll 65 to fuse the face side of the fabric driving off substantially the remainder of the wetting agent contained therein to provide a strong yet soft fabric 70. Roll 63 can be a smooth face roll having a polished metal surface or an embossed roll and can be heated by the means described for roll 27 of FIG. 1. The nip pressure of roll 63 is adjustable in the direction of the arrow 62 by means not shown to provide the desired amount of nip pressure during the fusion step. Backup roll 65 can be a hard rubber roll, a smooth roll, a heated smooth roll, a heated embossed roll, or optionally fabric covered as described above. The fused fabric 70 is then drawn around idler roll 67 by suitable takeup means which can be similar to that shown in FIG. 1.

Fused Thermoplastic Fabrics

The products of the present invention find utility in a variety of applications. The fused fabrics of the invention achieve improved dimensional stability without imparting a glazed or glossy finish to the fused face of the fabric which gives rise to a stiff, impermeable fabric with a hard hand. In fact, the fused fabrics of the invention retain the integrity of the individual fibers. Thus a fused product with a soft hand and ability to breathe, i.e., moisture permeability, is obtained.

Where wetted fabric is contacted with at least one heated embossing roll, a product with improved strength and a more defined embossing pattern results compared to embossing treatment of un-wetted fabric. Depending on the embossing pattern employed, the embossed product of the invention can be made to have any variety of surface patterns. The two patterns found to be the most common are those of a woven fabric and of the leather-like fabric. The leather-like fabric of the invention looks almost identical to a plastic film bonded to a fabric substrate. With respect to one fabric produced in accordance with this invention (see Example 9), a crosslapped, needle punched, non-woven, staple fiber polypropylene fabric embossed on one side with a leather-like embossing pattern was shown to several individuals unfamiliar with the method of fabric preparation. Each individual immediately attempted to peel back what they perceived to be a plastic film laminated to a fabric backing. Of course, the leather-like surface could not be removed from what was perceived to be the fabric backing. Those individuals viewing the fabric for the first time were amazed to learn that the fabric was simply a 100 percent crosslapped, needle punched, non-woven, staple fiber fabric Each individual further indicated that they would not have believed that the inventive fabric was not a laminate had they not had the opportunity to try to peel the expected layers apart.

Pattern definition achieved with the invention embossing process leads to production of fused fabric with excellent aesthetic appeal. In addition, pattern retention by the fused articles of the invention is enhanced over pattern retention in embossed fabrics prepared by prior art methods. The products of the invention are useful, for example, as furniture decking, carpet backing, automobile trunk liners, furniture upholstery and the like.

Where wetted, non-woven fabric is contacted with at least one heated smooth roll, the treated product has improved strength in both the warp (or machine) and the fill (or transverse) direction compared to comparable treatment of un-wetted fabric. It is especially noteworthy that the fabric strength in the warp direction is greatly increased, especially when a fabric produced from a crosslapped, needle punched, staple fiber web is treated according to the process of the invention. This is important since crosslapped, needle punched, staple fiber fabric is generally significantly weaker in the warp direction. Thus, the invention provides a fused, crosslapped, needle punched non-woven fabric with greatly reduced disparity between the warp and fill strengths. Further, fabric treated according to the invention has reduced thickness compared to fabrics fused by prior art methods, for a given weight of fabric. Thus, a fabric of reduced thickness could be employed in place of prior art treated fabric with comparable strength. The reduced thickness fabric has the advantage of occupying less volume, thus facilitating handling. Additional advantages include the excellent permeability of the fused fabric and the soft hand of the fused product of the invention. In fact, in instances where the feed fabric was a crosslapped, needle punched, non-woven fabric which was previously fused on one or both sides, the fused fabric of the present invention fused with a calender roll has a softer hand compared to the hand of the fused feed fabric. In other instances where the feed fabric was an unfused, crosslapped, needle punched, non-woven fabric, the fused fabric of the present invention had a soft hand substantially similar to the hand of the unfused feed fabric. Such products are useful, for example, in civil engineering applications such as settling pond liners, railroad bed liners, highway underliners and the like.

The following examples are provided merely to illustrate our invention and should not be read so as to limit the scope of our invention or the appended claims in any way.

EXAMPLES

In the examples which follow, several different feed fabric compositions were subjected to smooth calender roll or embossing treatment according to prior art methods (dry fusion) and according to the invention (wet fusion). The untreated, feed fabrics used in the examples were crosslapped, needle punched, non-woven fabrics which were either unfused (Example III), single stage fused (Examples VIII and IX), or double stage fused (Examples I, II, IV, V, VI, and VII) on the face side of the fabric. Single stage fused fabric was dry fused by infrared radiation such as disclosed in U.S. Pat. No. 4,151,023. Double stage fused fabrics were first dry fused by infrared radiation followed by a second dry fusion by a smooth calender roll. A variety of fabric physical properties were tested and are reported in the tables which follow. Where appropriate, reference is made to standard test procedures as reported, for example, by ASTM. In all of the examples, the wetting agent employed is water, reported in the tables as weight percent wetting agent which is based on the weight of the dry feed fabric. Roll pressure exerted at the nip is reported in the tables as nip roll pressure in pounds per lineal inch (pli).

EXAMPLE I

A crosslapped non-woven needle punched fabric weighing 3.5 oz./yd$^2$ was constructed of 4 denier by 4" long polypropylene staple fibers and fused on one side by double stage fusion. The fabric was treated on the fused side in an embossing apparatus similar to that of FIG. 1 with a cross-weave embossed pattern. The comparable properties and conditions for treating are shown in Table I. The data were normalized to the weight of untreated fabric for comparison.

TABLE I

| Fabric Properties | Untreated (control) | Treated Wet-Embossed (invention) |
|---|---|---|
| Warp elongation, % @ 10 lbs.(1) | 10 | 10 |
| Warp ultimate strength, lbs.(1) | 78 | 80 |
| Fill elongation, % @ 10 lbs.(1) | 18 | 19 |
| Fill ultimate strength, lbs.(1) | 98 | 104 |
| Processing Conditions | | |
| Line speed, FPM | | 20 |
| Temperature of heated roll, °F. | | 350° |
| Nip roll pressure, pli | | 2170–2437* |
| Wt. % wetting agent | | 60 |

(1)ASTM D 1682-64
*Fabric width varied from 66 to 74" with constant gauge pressure applied to the backup roll.

The treated fabric had good pattern definition which could not be affected by pulling on the sides of the fabric. The ultimate strength was increased in both the warp and fill directions.

EXAMPLE II

A crosslapped, needle punched, non-woven polypropylene fabric, double-stage fused on one side and weighing 6.26 oz./yd$^2$ made from 4 denier by 4" long staple fibers was treated on the fused side in the same embossing apparatus with a cross-weave embossed pattern employing both dry (prior art) and wet (invention) techniques. The data were normalized to the weight of the untreated fabric for comparison.

TABLE II

| Fabric Properties | Untreated | Treated Dry-Embossed (control) | Treated Wet-Embossed (invention) |
|---|---|---|---|
| Warp elongation, % @ 10 lbs. | 14 | 7 | 9 |
| Warp ultimate strength, lbs. | 104 | 95 | 111 |
| Fill elongation, % @ 10 lbs. | 6 | 7 | 7 |
| Fill ultimate strength, lbs. | 159 | 153 | 176 |
| Mullen Burst Test, lbs.(1) | 379 | 320 | 360 |
| Puncture, lbs.(2) | 87 | 74 | 98 |
| Gauge, mils | 91 | 77 | 49 |
| Processing Conditions | | | |
| Line speed, FPM | | 10 | 10 |
| Temperature of heated roll, °F. | | 350° | 350° |
| Nip roll pressure, pli | | 2965 | 2965 |
| Wt. % wetting agent | | 0 | 20 |

(1)ASTM D 231 62
(2)ASTM D 751 Modified

The ultimate strength of the dry embossed fabric decreased in both the warp and fill directions, while a substantial increase in ultimate strength in both the warp and fill direction was obtained when the untreated feed fabric was wet embossed according to the present invention. The dry embossed fabric showed a decrease in strength as measured by the Mullen burst test and puncture while the wet embossed fabric showed improved strength according to these tests compared to dry embossed fabric. Significantly the wet embossed fabric gave improved physical characteristics with a decrease in fabric thickness (gauge). The pattern definition of the wet embossed was more defined than that of the dry embossed fabric.

EXAMPLE III

A crosslapped, needle punched non-woven, unfused polypropylene fabric weighing 8.3 oz./yd$^2$ made 4 denier by 4" long staple fibers was processed on an embossing apparatus similar to FIG. 1 with a cross-weave embossed pattern. The treated fabric weighed 8.7 oz./yd$^2$. Data were normalized to the weight of the untreated fabric for comparison.

TABLE III

| Fabric Properties | Untreated (control) | Treated Wet-Embossed (invention) |
|---|---|---|
| Warp elongation, % @ 10 lbs. | 23 | 11 |
| Warp ultimate strength, lbs. | 174 | 183 |
| Fill elongation, % @ 10 lbs. | 28 | 10 |
| Fill ultimate strength, lbs. | 229 | 243 |
| Mullen Burst Test, lbs. | 439 | 421 |
| Puncture, lbs. | 161 | 150 |
| Processing Conditions | | |
| Line speed, FPM | | 10 |
| Temperature of heated roll, °F. | | 360° |
| Nip roll pressure, pli | | 2437 |
| Wt. % wetting agent | | 25 |

The fabric treated according to the invention exhibited good pattern definition. The elongation in both the warp fill direction was greatly reduced and the ultimate strength increased, compared to untreated fabric.

EXAMPLE IV

A crosslapped, needle punched, non-woven, unfused polypropylene fabric weighing 4.0 oz./yd$^2$ was constructed from 60% 5 denier by 4" long fibers and 40% 10 denier by 4" long fibers. The fabric was treated on the fused side in an apparatus similar to FIG. 1 equipped with a smooth calender roll. The process conditions and physical characteristics of the fabric are shown in Table IV. The data were normalized to a fabric weight of 4.0 oz./yd$^2$ for ease of data comparison.

TABLE IV

| Fabric Properties | | Treated | | | |
|---|---|---|---|---|---|
| | | Dry Calender (control) | Wet Calender | Wet Calender (invention) | Wet Calender |
| Run No. | Untreated | 1 | 2 | 3 | 4 |
| Warp elongation, % @ break | 102 | 94 | 83 | 76 | 82 |
| Warp ultimate strength, lbs. | 76 | 72 | 95 | 104 | 109 |
| Fill elongation, % @ break | 129 | 120 | 125 | 129 | 121 |
| Fill ultimate strength, lbs. | 77 | 77 | 87 | 76 | 90 |
| Mullen Burst Test, lbs. | 199 | 144 | 221 | 211 | 195 |
| Tear Strength, lbs.(1) | | | | | |
| Warp | 38 | 31 | 46 | 41 | 43 |
| Fill | 43 | 32 | 49 | 45 | 49 |
| Processing Conditions | | | | | |
| Line speed, FPM | | 25 | 25 | 25 | 25 |
| Temperature of heated roll, °F. | | 340 | 348 | 348 | 348 |
| Temperature of backup roll, °F. | | Unheated | Unheated | 320 | 340 |
| Nip roll pressure, pli | | 358 | 358 | 358 | 358 |
| Wt. % wetting agent | | 0 | 180 | 180 | 180 |

(1)ASTM D 2261-64T

The data show a significant reduction in elongation and increase in ultimate strength in the warp direction for wet calender fusion compared to dry calender fusion. The dry calender fused feed fabric shows a loss in warp tear strength and Mullen burst data while the feed fabrics treated by wet calender fusion show an increased strength according to these tests. It is significant that the warp ultimate strength in the invention runs is increased more than the fill ultimate strength in the wet calender fusion runs such that warp ultimate strength is actually greater than fill ultimate strength for invention treated fabrics.

EXAMPLE V

A crosslapped, needle punched, non-woven polypropylene fabric weighing 18.45 oz./yd$^2$ was constructed of 10 denier by 4" long staple fibers. The fabric was double stage fused on one side and processed on an embossing apparatus similar to FIG. 1 with a cross-weave embossed pattern. The data were normalized to 16 oz./yd$^2$ for comparison.

TABLE V

| Fabric Properties | Untreated (control) | Treated Wet-Embossed (invention) |
|---|---|---|
| Warp Elongation % @ break | 104 | 106 |
| Warp Ultimate Strength, lbs. | 404 | 571 |
| Fill Elongation, % @ break | 139 | 98 |
| Fill Ultimate Strength, lbs. | 845 | 857 |
| Mullen Burst Test, lbs. | 742 | 761 |
| Gauge, Mils | 207 | 86 |
| Processing Conditions | | |
| Line speed, FPM | | 10 |
| Temperature of heated roll, °F. | | 370 |
| Temperature of backup roll, °F. | | Unheated |
| Nip roll pressure, pli | | 2427 |
| Wt. % wetting agent | | 180 |

The treated fabric exhibited good pattern definition. A significant increase was obtained in the fabric warp ultimate strength as well as a significant decrease in fabric gauge.

EXAMPLE VI

A crosslapped, needle punched, non-woven polypropylene fabric weighing 4½ oz./yd$^2$ was constructed of a blend of 30% 4 denier by 4½" long staple fibers and 70% 5 denier by 4" long fibers. The fabric was double stage fused on one side and was processed on a calender apparatus similar to FIG. 1 with a smooth calender roll.

TABLE VI

| Fabric Properties | Dry Calender (control) | Wet Calender (invention) | |
|---|---|---|---|
| Run No. | 1 | 2 | 3 |
| Tensile Strength @ 10% elongation, lbs.(1) | | | |
| Warp Direction | 12 | 4 | 4 |
| Fill Direction | 8 | 1 | 1 |
| Tensile Strength @ 20% elongation, lbs.(1) | | | |
| Warp Direction | 9 | 8 | 8 |
| Fill Direction | 12 | 2 | 2 |
| Tensile Strength @ 33% elongation, lbs.(1) | | | |
| Warp Direction | 26 | 17 | 18 |
| Fill Direction | 17 | 4 | 4 |
| Ultimate Strength, lbs.(1) | | | |
| Warp Direction | 94 | 104 | 99 |
| Fill Direction | 103 | 100 | 110 |
| Processing Conditions | | | |
| Temperature of heated roll, °F. | 335 | 345 | 365 |
| Temperature of backup roll, °F. | Unheated | Unheated | Unheated |
| Line Speed FPM | 25 | 25 | 25 |
| Nip roll pressure, pli | 358 | 358 | 358 |
| Wt. % Wetting Agent | | 70 | 70 |

(1)ASTM D-1682 64

While the tensile strength at 10, 20, and 33% elongation was lower for wet calendered fabrics compared with dry calendered fabrics, the ultimate tensile strength at break was increased in the warp direction and comparable to or increased in the fill direction for wet calendered fabric compared to dry calendered fabric. These results are consistent with the dry calendered fabric having a hard hand and a glazed, skin-like surface. The fabric displays good strength characteristics so long as the glazed skin-like surface remains intact. However, once the surface skin is broken, the fabric ultimate strength is seen to be less than the ultimate strength for wet calendered fabric. The results are also consistent with the wet calendered fabric having a soft hand and more uniform fusion throughout the thickness of the fabric.

EXAMPLE VII

A crosslapped, needle punched, non-woven fabric weighing 4.5 oz./yd$^2$ and double stage fused on one side was made from a blend of 10% polyester binder fibers 2.25 denier by 1.5" long, 25% 4 denier by 4½" long polypropylene fibers and 65% 5 denier by 4" long polypropylene staple fibers. The fabric was treated on the fused side in a calender apparatus similar to FIG. 1 with a smooth calender roll.

TABLE VII

| Fabric Properties | Dry Calender (control) | Wet Calender (invention) | |
|---|---|---|---|
| Run | 1 | 2 | 3 |
| Tensile Strength @ 10% elongation, lbs. | | | |
| Warp Direction | 11 | 13 | 6 |
| Fill Direction | 11 | 5 | 2 |
| Tensile Strength @ 20% elongation, lbs. | | | |
| Warp Direction | 17 | 26 | 13 |
| Fill Direction | 16 | 10 | 4 |
| Tensile Strength @ 33% elongation, lbs. | | | |
| Warp Direction | 23 | 48 | 27 |
| Fill Direction | 21 | 15 | 6 |
| Tensile Strength at break, lbs. | | | |
| Warp Direction | 90 | 104 | 102 |
| Fill Direction | 104 | 102 | 100 |
| Processing Conditions | | | |
| Temperature of Heated Roll, °F. | 335 | 345 | 365 |
| Temperature of Backup Roll, °F. | Unheated | Unheated | Unheated |
| Line Speed, FPM | 25 | 25 | 25 |
| Nip roll pressure, pli | 358 | 358 | 358 |
| Wt. % Wetting Agent | | 50 | 50 |

Although the tensile strength at 10, 20 and 33% elongation was lower for wet calendered fabric compared to dry calendered fabric, tensile strength at break, especially in the warp direction, was significantly improved for the wet calendered fabric compared to the dry calendered fabric. Further, the fused fabrics of the invention had a greater degree of fusion compared to the feed fabric and had a softer hand compared to the hand of the feed fabric or the hand of the control fabric.

EXAMPLE VIII

A crosslapped, needle punched, non-woven polypropylene fabric fused on one side by single stage fusion and weighing 5.0 oz./yd$^2$ was made from 5 denier by 4" long staple fibers and treated on the fused side in an apparatus similar to FIG. 1 with a smooth calender roll.

TABLE VIII

| Fabric Properties | Untreated | Treated | |
|---|---|---|---|
| | | Dry-Calendered (control) | Wet-Calendered (invention) |
| Elongation @ Break, % | | | |
| Warp Direction | 97 | 86 | 83 |
| Fill Direction | 107 | 102 | 96 |
| Ultimate Strength, lbs. | | | |
| Warp Direction | 114 | 136 | 149 |
| Fill Direction | 140 | 154 | 148 |
| Mullen Burst Test | 234 | 217 | 227 |
| Puncture | 94 | 76 | 99 |
| Gauge, Mils | 70 | 40 | 48 |
| EOS (Equivalent Opening Size) Seive(1) | | 120 | 100 |
| Processing Conditions | | | |
| Line Speed, FPM | | 25 | 25 |
| Temperature of Calender Roll, °F. | | 348 | 348 |
| Temperature of Backup Roll, °F. | | Unheated | Unheated |
| Nip roll pressure, pli | | 268 | 268 |

TABLE VIII-continued

| Fabric Properties | Untreated | Treated Dry-Calendered (control) | Treated Wet-Calendered (invention) |
|---|---|---|---|
| Wt. % Wetting Agent | | | 65 |

(1)CW-02215 U.S. Standard Test Method for Seives

Significantly the wet calendered fabric shows a substantially balanced strength in both the warp and fill directions. The wet calendered fabric shows increased porosity along with the increased strength. Again, the hand of the fabrics of the invention was softer compared to the hand of the fused feed fabrics or the control dry-fused fabric.

EXAMPLE IX

A crosslapped, needle punched, non-woven polypropylene fabric single stage fused on one side and weighing 6.18 oz./yd.$^2$ made from 4 denier by 4" long staple fibers was treated on the fused side in an apparatus similar in FIG. 1 using an embossing roll with a leather-like pattern.

TABLE IX

| Fabric Properties | Untreated (control) | Treated Wet-Embossed (invention) |
|---|---|---|
| Warp elongation, % @ 10 lbs. | 13 | 7 |
| Warp ultimate Strength, lbs. | 119 | 120 |
| Fill elongation, % @ break | 8 | 5 |
| Fill ultimate strength, lbs. | 179 | 159 |
| Tear strength, lbs. | | |
| Warp | 36 | 39 |
| Fill | 52 | 48 |
| Mullen Burst Test, lbs. | 305 | 324 |
| Processing Conditions | | |
| Line Speed, FPM | | 25 |
| Temperature of heated roll, °F. | | 340 |
| Temperature of backup roll, °F. | | unheated |
| Nip roll pressure, pli | | 1296 |
| Wt. % Wetting Agent | | 50 |

The wet embossed fabric of this example retained to a significant degree, the strength displayed by the untreated feed fabric. The most notable feature of the treated fabric was the aesthetic appearance of a leather-like surface with a two-tone cast. The wet embossed fabric had the appearance of being a laminate of an impervious layer of plastic on a layer of fabric, but the fabric of the invention was simply a single layer of fabric which retained the porous nature of the unfused non-woven feed fabric from which it was prepared. The leather-like appearance of the wet embossed fabric gave the perception of a non-porous surface, but the fabric was surprisingly porous.

That which is claimed is:

1. A fused, crosslapped, needle punched, non-woven fabric comprising thermoplastic staple fibers, said fabric having a first surface and a second surface; wherein at least said first surface is porous and has a leather-like appearance.

2. A fabric according to claim 1 wherein said thermoplastic staple fibers comprise polypropylene staple fibers.

3. A fused, crosslapped, needle punched, non-woven fabric comprising thermoplastic staple fibers; wherein at least a portion of the fibers of said fabric are fused by interfiber fusion; wherein at least one surface of said fabric having a defined embossed pattern thereon; and wherein said defined embossed pattern is resistant to pullout in either the machine or transverse-machine direction.

4. A fabric according to claim 3 wherein said thermoplastic staple fibers comprise polypropylene staple fibers.

5. A fused, crosslapped, needle punched, non-woven fabric comprising thermoplastic staple fibers; wherein at least a portion of the fibers throughout the thickness and also across full width of said fabric are fused by interfiber fusion, wherein said fabric has a substantially balanced strength in the machine and the transverse-machine direction.

6. A fused fabric produced from a fused, crosslapped, needle punched, non-woven feed fabric having a greater degree of fusion compared to the feed fabric and having a softer hand compared to the feed fabric.

7. A fused fabric produced from an unfused, crosslapped, needle punched, non-woven feed fabric having a soft hand substantially similar to the hand of the unfused feed fabric.

* * * * *